US005534843A

United States Patent [19]

Tsunoda et al.

[11] Patent Number: 5,534,843

[45] Date of Patent: Jul. 9, 1996

[54] THERMISTOR

[75] Inventors: Masakiyo Tsunoda; Hiroaki Nakajima; Masami Koshimura, all of Saitama-Ken, Japan

[73] Assignee: Mitsubishi Materials Corporation, Tokyo, Japan

[21] Appl. No.: 189,163

[22] Filed: Jan. 28, 1994

[30] Foreign Application Priority Data

Jan. 28, 1993 [JP] Japan ..... 5-032755

[51] Int. Cl.[6] ..... H01C 7/10

[52] U.S. Cl. ..... 338/22 R; 338/225; 338/262; 338/324; 338/332

[58] Field of Search ..... 338/22 R, 225 D, 338/262, 322, 323, 324, 332

[56] References Cited

U.S. PATENT DOCUMENTS 5,210,516 5/1993 Shikama et al. ..... 338/22 R

*Primary Examiner*—Tu Hoang

*Attorney, Agent, or Firm*—Christopher R. Pastel; Thomas R. Morrison

[57] ABSTRACT

An insulating glass layer covers the surface of a thermistor element except at the two end surfaces. The insulating glass layer is partially or fully composed of crystallized glass. A terminal electrode is integrally formed on both end surfaces. The terminal electrodes include a baked-on electrode layer formed from a conductive paste. Layers of nickel and tin or lead/tin are plated onto the baked-on electrode. The insulating glass layer enhances shape-maintainability of the insulating glass layer and the baked-on electrodes, provides a smoother glass surface, resulting in a more aesthetically pleasing thermistor, prevents resistance variance due to plating of the baked-on electrodes and provides a strong anti-breaking strength thermistor. The coefficient of thermal expansion of the glass layer is less than the coefficient of thermal expansion of the thermistor element. This difference in coefficients of thermal expansion tends to help the thermistor element resist stress breakage.

20 Claims, 6 Drawing Sheets

THERMISTOR

BACKGROUND OF THE INVENTION

The present invention relates to thermistors which measure the surface temperature of electronic devices and which are used in temperature compensation for the same. More particularly, the invention relates to chip-type thermistors, such as those adapted for surface mounting on printed circuit boards.

A prior art chip-type thermistor includes a thermistor element having silver-palladium electrodes fused at both ends thereof. The palladium imparts soldering heat resistance to the electrode, thereby preventing the silver from dissolving when soldering a chip-type thermistor to a substrate.

A drawback of the prior art is that palladium decreases the solder adhesion of the electrode to the substrate, thereby establishing an upper limit on the amount of palladium which can be used. When soldering the electrode at high temperature continues for a long period of time, however, limit amount of palladium is insufficient to impart adequate soldering heat resistance to the electrode.

The prior art thermistor improves soldering heat resistance and soldering adhesion by providing a plating layer on the surface of the electrodes, as in the case of a chip-type capacitor. A drawback of this technique is that, since a thermistor element is electrically conductive (unlike the capacitor), plating a conductive material directly on the surface of the thermistor element alters the resistance value of the thermistor element from the desired or expected value. In addition, a portion of the thermistor element is eroded by the plating liquid, thereby reducing the life and reliability of the thermistor.

Referring to FIGS. 10, 11(*a*) and 11(*b*), Japanese Laid-Open Patent Publication No. 3-250,603 discloses a chip-type thermistor 5 which attempts to overcome the above drawbacks. A thermistor element 1 includes a glass layer 2 covering all but the ends of thermistor element 1. An electrode layer 4 is baked on the ends of thermistor element 1. Glass layer 2 has a softening point approximately equivalent to the baking temperature of a baked-on electrode layer 4. A protective plating layer (not shown) covers baked-on electrode layer 4. The protective plating layer may be, for example, nickel.

Although chip-type thermistor 5 has good solder adhesiveness, good solder heat resistance and could decrease discrepancies in resistance values, problems occur because the softening point of glass layer 2 is approximately the same as the baking temperature of baked-on electrode layer 4.

Referring now also to FIGS. 11(*a*) and 11(*b*), glass layer 2, at the edge of thermistor element 1, softens when baked-on electrode layer 4 is baked on to glass layer 2 and thermistor element 1. This permits glass layer 2 to flow easily downward from the edge. In extreme cases, glass layer 2 disappears from the edge area and causes thermistor element 1 to be left exposed. In addition, the shape of glass layer 2 is often distorted during processing.

Referring specifically to FIG. 10, another problem is that during the baking on of baked-on electrode layer 4, thermistor element 1 may be placed on baking tools such as a baking platform or a baking sheath. Furthermore, a group of chip-type thermistors 5 can be baked at the same time. This can cause glass layer 2 to melt and stick to the baking tools or to other chip-type thermistors, leaving a contact mark or a melt mark 3 on glass layer 2.

Referring to FIG. 11(*b*), a further problem is that the glass frit, which is melted to form baked-on electrode layer 4 reacts with glass layer 2. The glass frit melts into glass layer 2 and, in extreme cases, both glass layer 2 and baked-on electrode layer 4 flow away at the edge of thermistor element 1, again, leaving thermistor element 1 exposed.

Japanese Laid-open publication No. 3-250604 discloses a thermistor made of a glass containing crystals of inorganic compounds such as alumina, zirconia and magnesia. The glass and the inorganic crystals are mixed together in a powder state. An organic binder and solvent are added to this mixture to create a paste. This paste is printed and baked onto the thermistor element, forming a glass layer. The above-noted problem is solved because the presence of the inorganic crystal powder in the glass layer of this thermistor increases the softening point of the resulting glass layer as compared to the glass layer for the thermistor formed by Japanese Laid-open publication No. 3-250603.

A drawback of the thermistor made by Japanese Laid-open publication No. 3-250604 is that it is difficult to mix uniformly the inorganic crystal powder and the glass powder. The resulting paste is difficult to print on to the thermistor element and results in non-uniform distribution over the surface of the thermistor element.

A further drawback is that bubbles are formed and remain in the glass layer because of the presence of the inorganic crystals. The bubbles tend to burst and become open pores. This allows plating fluid to infiltrate into the pores during the plating process. The plating fluid erodes the thermistor element and decreases the reliability of the thermistor. Finally, the surface of the glass layer becomes irregular and uneven due to the baking on of the baked-on electrode layer. This damages the appearance and changes the expected resistance value of the thermistor.

OBJECTS AND SUMMARY OF THE INVENTION

Accordingly, it is an object of the invention to provide a thermistor element which overcomes the drawbacks of the prior art.

It is a further object of the present invention to provide a thermistor with a glass layer and a baked-on electrode layer having good shape-maintaining qualities.

It is a still further object of the present invention to provide a thermistor with a glass layer and a baked-on electrode layer such that the glass layer or the baked-on electrode layer at the edge of the thermistor element is not destroyed during the baking process.

It is still a further object of the present invention to provide an aesthetically pleasing thermistor with a flat and smooth glass layer surface.

It is yet still a further object of the present invention to provide a thermistor with a glass layer that does not have contact marks or melt marks on the thermistor surface caused by various baking tools.

It is yet a further object of the invention to provide a thermistor with increased soldering heat resistance and soldering adhesion.

It is yet a still further object of the invention to provide a thermistor having terminal electrodes which minimizes the change in resistance values due to plating.

It is yet a further object of the present invention to provide a thermistor that is strong against tensile stress caused by heat stress.

Briefly stated, the present invention provides an insulating glass layer covering the surface of a thermistor element except at the two end surfaces. The insulating glass layer is partially or fully composed of crystallized glass. A terminal electrode is integrally formed on both end surfaces. The terminal electrodes include a baked-on electrode layer formed from a conductive paste. Layers of nickel and tin or lead/tin are plated onto the baked-on electrode. The insulating glass layer enhances shape-maintainability of the insulating glass layer and the baked-on electrodes, provides a smoother glass surface, resulting in a more aesthetically pleasing thermistor, prevents resistance variance due to plating of the baked-on electrodes and provides a strong anti-breaking strength thermistor. The coefficient of thermal expansion of the glass layer is less than the coefficient of thermal expansion of the thermistor element. This difference in coefficients of thermal expansion tends to help the thermistor element resist stress breakage.

According to an embodiment of the invention, there is provided a thermistor comprising: a thermistor element having first and second opposed end surfaces, and first, second third and fourth peripheral sides, an insulating glass layer on the first, second third and fourth peripheral sides, the first and second opposed end surfaces being substantially free of the insulating glass layer, the insulating glass layer being at least partially crystallized glass, and a terminal electrode on each of the first and second opposed end surfaces.

According to a feature of the invention, there is provided a method for producing a thermistor, comprising: preparing a ceramic sintered sheet having a pair of opposing surfaces, covering the pair of opposing surfaces of the ceramic sintered sheet with a glass paste, baking the ceramic sintered sheet at a predetermined temperature to form an insulating glass layer composed at least partially of crystallized glass layer, cutting the ceramic sintered sheet into a plurality of strips each having a pair of longitudinal side surfaces, covering the pair of longitudinal side surfaces with the glass paste, cutting the plurality of strips into a plurality of chips each having a pair of uncovered ends, applying a conductive paste to each of the pair of uncovered ends, and baking the plurality of chips to form a baked-on electrode layer on each of the pair of uncovered ends.

According to a further feature of the invention, there is provided a thermistor comprising: a thermistor element, the thermistor element including first, second, third and fourth contiguous peripheral sides, an insulating glass layer on the first, second, third and fourth contiguous peripheral sides, and the insulating glass layer having a coefficient of thermal expansion that is less than a thermal expansion of the thermistor element.

The above, and other objects, features and advantages of the present invention will become apparent from the following description read in conjunction with the accompanying drawings, in which like reference numerals designate the same elements.

BRIEF DESCRIPTION OF DRAWINGS

FIG. 11(*b*) is an enlarged cross-sectional view taken along line C—C.

DETAILED DESCRIPTION OF THE PREFERRED EMBODIMENTS

Figure 1:
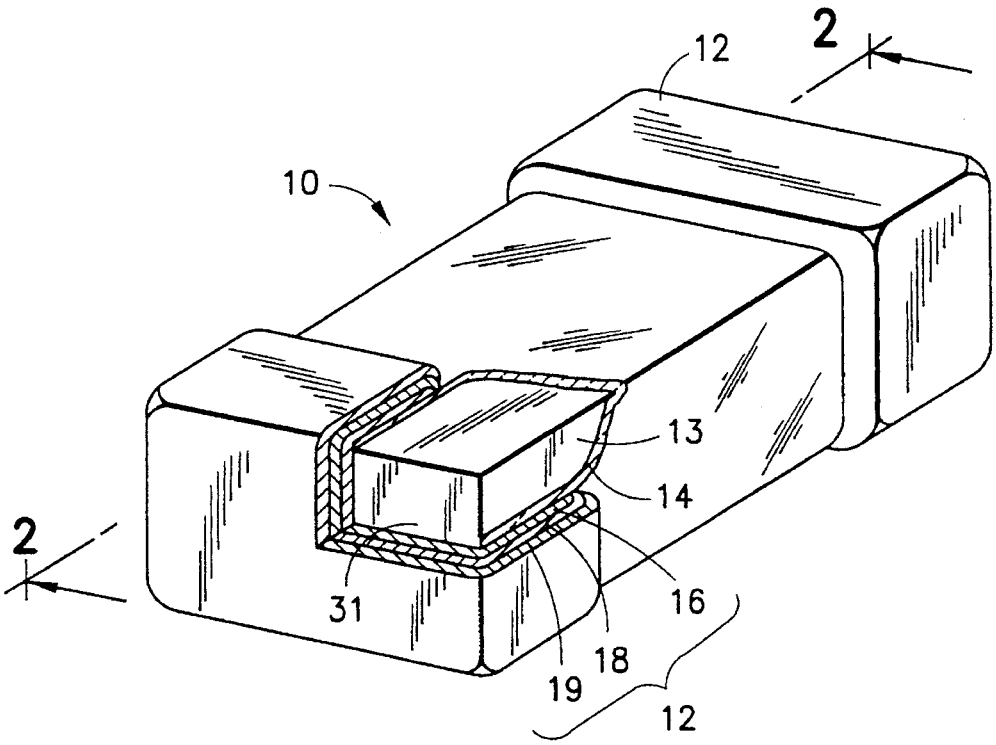
FIG. 1 is a perspective view, partially in cross section, of a thermistor according to a first embodiment of the present invention.
Figure 2:
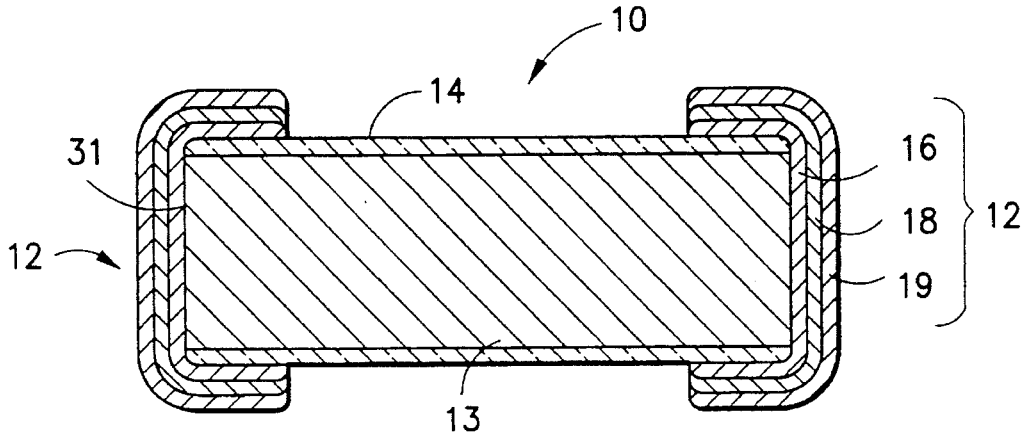
FIG. 2 is a longitudinal cross-sectional view of the first embodiment taken along line A—A in FIG. 1.
Figure 3A:
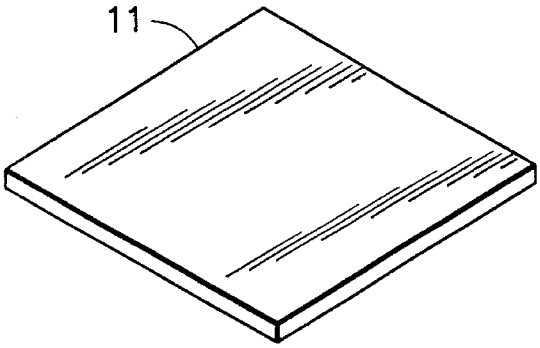
FIGS. 3(*a*)–3(*f*) illustrate the steps for manufacturing the embodiment of FIG. 1.
Figure 3D:
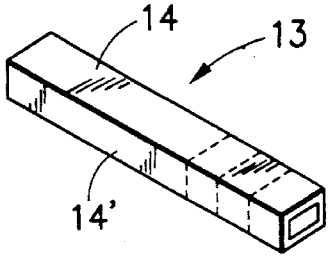
Figure 3B:
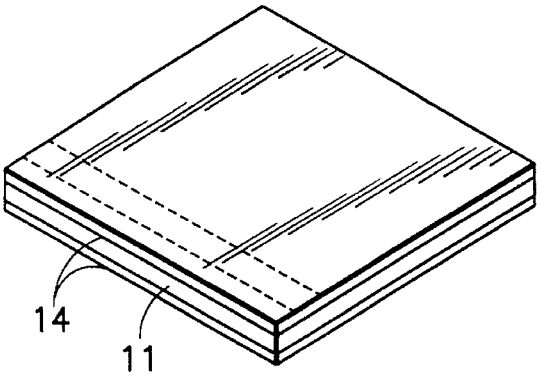
Figure 3E:
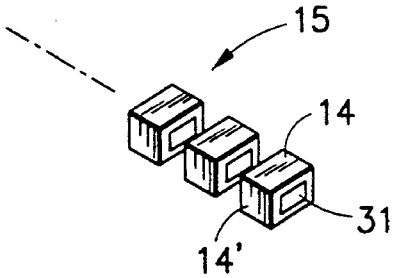
Figure 3C:
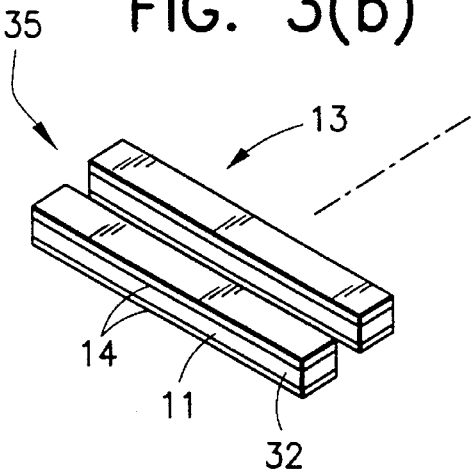
Figure 3F:
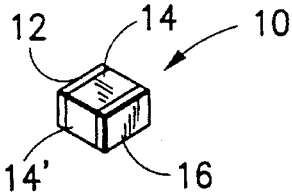

Referring to FIGS. 1 and 2, a thermistor 10 includes a thermistor element 13. Thermistor element 13 is covered by an insulating glass layer 14, which covers the entire surface of thermistor element 13 except for a pair of end surfaces 31. A pair of terminal electrodes 12 are formed on end surfaces 31 of thermistor 10. Each of the terminal electrodes 12 includes a baked-on electrode layer 16, a Ni plating layer 18 and a Sn or a Sn/Pb plating layer 19.

Insulating glass layer 14 is either partly or entirely made of crystallized glass. The glass transition point of this glass, before it is heat treated for crystallization, is in the range of about 400 to about 1,000 ÛC. The crystallizing temperature is higher than the glass transition point of the glass. This is described in more detail below.

Referring to FIGS. 3(*a*)–3(*f*), the above embodiment is manufactured as follows. Referring specifically to FIG. 3(*a*), a ceramic sintered sheet 11 is prepared from one or a mixture of two or more-metal oxides. For example, the metal oxides can be Mn, Fe, Co, Ni, Cu, or Al. The mixture is pre-heated, crushed and mixed with an organic binder and formed into a block. The block is heated to its sintering temperature to form a ceramic sintered body (not shown). The ceramic sintered body is then cut to form a plurality of sheets 11.

Referring now to FIG. 3(*b*), ceramic sintered sheet 11 is coated on both sides with frit precursor to an insulating glass layer 14. The combination is then baked to form insulating glass layer 14.

Referring now to FIG. 3(*c*), coated ceramic sintered sheet 11 is cut by any convenient means such as, for example, a handsaw, a dicing saw, or a cutter with a diamond blade to form strips 35. Cut strips 35 now have exposed sides 32 in which ceramic sintered sheet 11 and insulating glass layers 14 can be seen.

Alternatively, after the pre-heating and crushing steps, the resulting powder can be milled with an organic binder and a solvent to form a slurry. The resulting slurry is then spread by, for example, a doctor blade, to form a green sheet, which is then dried to form a membrane. The green sheet is baked at sintering temperature to form ceramic sintered sheet 11. The remainder of the steps for this embodiment are the same as described.

Referring to FIG. 3(*d*), a glass paste is printed on the now exposed sides 32 of thermistor element 13. The glass paste on exposed sides 32 is baked to form an insulating glass layer 14' covering the two exposed sides 32 of strip 35.

Referring now to FIG. 3(*e*), each strip 35 is cut perpendicular to its long axis to form chips 15 having exposed end surfaces 31.

Referring to FIG. 3(*f*), a conductive paste, composed of an inorganic binder and a conductive material such as, for example, a precious metal powder, is applied to end portions of chip 15, including end surfaces 31. The chips are heated to bake the conductive paste and thus to form baked-on terminal electrodes 16. Baked-on terminal electrodes 16 are completed to form terminal electrodes 12 by covering baked-on terminal electrodes 16 with a Ni plating layer and a Sn or a Sn/Pb plating layer over the Ni plating layer (the Ni and Sn/Pb plating layers are not shown separately in FIGS. 3(*a*)–3(*f*).

Insulating glass layer 14 is composed in part or entirely from crystallized glass. Generally, insulating glass layers 14 and 14' have thicknesses of approximately 10–30 microns. If insulating glass layer 14 is partially crystallized glass, a crystallization of at least 10% is desirable for the present invention to achieve its objective.

Crystallized glass is a glass ceramic made from baking a uniform non-crystal glass at a time and temperature schedule near the softening point of the uniform non-crystal glass, thereby creating collections of fine crystals. In order to make crystallized glass, a non-crystallized glass powder (raw glass powder) is selected and combined with the glass paste in a proportion that enables crystallization. The dried glass paste is baked at a specified temperature effective to crystallize a desired portion of the glass contained in the glass paste.

The glass in insulating glass layers 14 and 14 ', prior to the heat treatment, have a glass transition point in the range of 400–1,000 ÛC. The crystallization temperature of the glass is higher than the transition point of the glass.

The transition point of the glass in insulating glass layer 14 is determined by the baking temperature of baked-on electrode layer 16. If Ag is used in baked-on electrode layer 16, the baking temperature is from 600–850 ÛC. If the transition point of the glass is significantly lower than this temperature, the crystallized glass can degenerate during baking of baked-on electrode layer 16. For example, when the pre-crystallized glass transition point is below 400° C., the crystallization temperature can be lower than 600 ÛC. When the transition point of the pre-crystallized glass is over 1000 ÛC, the crystallization temperature exceeds 1000 ÛC. The resulting high baking temperature can degrade the electrical characteristics of thermistor element 13.

The desired coefficient of thermal expansion for the crystallized glass is from 40 to 100 percent of the coefficient of thermal expansion for thermistor element 13. The preferred range is from 50 to 90 percent. The coefficient of thermal expansion is important in determining the anti-breaking strength of the thermistor.

The term "anti-breaking strength" refers to the disruptive strength, tested by placing the ends of thermistor 10 on spaced-apart platforms and by applying a load in the center of thermistor element 13 until thermistor element 13 breaks. Anti-breaking strength is an index to the amount of resistance thermistor 10 has to the stress (mechanical stress) from the mounting device when thermistor 10 is mounted on a printed circuit board or to stress strain (heat stress) that is caused by heat from soldering or from the in-use heat cycle after mounting is completed.

When the coefficient of thermal expansion of the crystallized glass is in a preferred range between about 40 and 100 percent, the anti-breaking strength is greater than that of a thermistor without a glass layer. It is also greater than that of a thermistor with a glass layer made of uncrystallized glass, having a coefficient of thermal expansion within the above range.

When the coefficient of thermal expansion of the crystallized glass is in a more preferred range between about 50 to 90 percent, the anti-breaking strength is from about 20 to about 70 percent greater than a thermistor having no glass layer or a thermistor with a glass layer made of uncrystallized glass. If the coefficient of thermal expansion is outside of the 40 to 100 percent range, then the anti-breaking strength is lower as compared to a thermistor without a glass layer and as compared to a thermistor with a glass layer made of uncrystallized glass.

It is believed that the increased anti-breaking strength in thermistor 10 is due to compression stresses remaining in insulating glass layer 14 that tend to reinforce thermistor 10 against breaking. During baking, thermistor element 13 expands. During cooling, thermistor element 13 contracts an amount greater that the contraction that insulating glass layer 14 would contract by itself. The result is that insulating glass layer 14 is held in compression at environmental temperatures, thus improving the anti-breaking strength of insulating glass layer 14. This increased strength is attained in a manner similar to prestressed concrete. In prestressed concrete, steel reinforcing bars are held in tension while the concrete sets around them. After the concrete is cured, the tension on the reinforcing bars is released. As a result, the concrete which, like insulating glass layer 14, has poor resistance to tensile stresses, is held in compression, and its breaking strength is greatly increased. In the present application, during cooling of thermistor 10, the higher temperature coefficient of expansion of thermistor element 13 tends to shrink thermistor element 13 more than the free shrinkage of insulating glass layer 14. This applies compressive stress to insulating glass layer 14. Thus, at environmental temperatures, thermistor element 13 prestresses insulating glass layer 14 in a manner analogous to the way that steel reinforcing bars prestress the concrete surrounding them.

In this compressed state, when a bending force is applied to thermistor 10, a compression stress is formed on the inside of the bend and a tensile stress is formed on the outside. Thermistor element 13 and insulating glass layer 14 are both strong against compression stress and weak against tensile stress. Therefore, when a compression prestress is applied to the glass layer, it is harder for a crack to form from the tensile stress on the outside of the bend as compared to thermistors having no glass layer and thermistors with glass layers made of uncrystallized glass.

Referring again to FIG. 2, the present invention limits Ni plating layer 18 and Sn or Sn/Pb plating layer 19 to the surface of baked-on electrode 16. The present invention prevents erosion of thermistor element 13 by the plating fluids and improves adhesion of the plating to thermistor element 13. Therefore, the resistance value of thermistor 10 remains unchanged from its desired value. Ni plating layer 18 increases solder heat resistance. It prevents baked-on electrode layer 16 from corrosion by solder when thermistor 10 is soldered onto a substrate. Sn or Sn/Pb plating layer 19 over Ni plating layer 18 improves solder adhesion of terminal electrodes 12. As stated above, baked-on electrode layer 16 is composed of precious metals. Since Ni plating layer 18 and Sn or Sn/Pb plating layer 19 cover the surface of baked-on electrode layer 16, they inhibit ion movement in the precious metals. This further stabilizes the resistance value of thermistor element 13.

Also, since insulating glass layer 14 is made of crystallized glass, there is little decrease in the viscosity of the glass itself during formation of baked-on electrode layer 16. This prevents insulating glass layer 14 and baked-on electrode layer 16 in the edge area of thermistor element 13 from eroding away. Furthermore, insulating glass layer 14 does not show imprints from sticking or contact with baking tools after formation of baked-on electrode layer 16.

Unlike the prior art, the glass paste does not include inorganic crystals to form insulating glass layer 14. This simplifies printing of the glass paste onto thermistor element 13. Since the crystallizing temperature is reached during formation of insulating glass layers 14 and 14', by passing through the glass transition point, this results in the formation of a fine crystal structure within insulating glass layer 14. Furthermore, since there are no inorganic crystals in the glass paste, the formation of bubbles during the heating process is inhibited. This results in thermistor 10 having a smooth surface.

Figure 4:
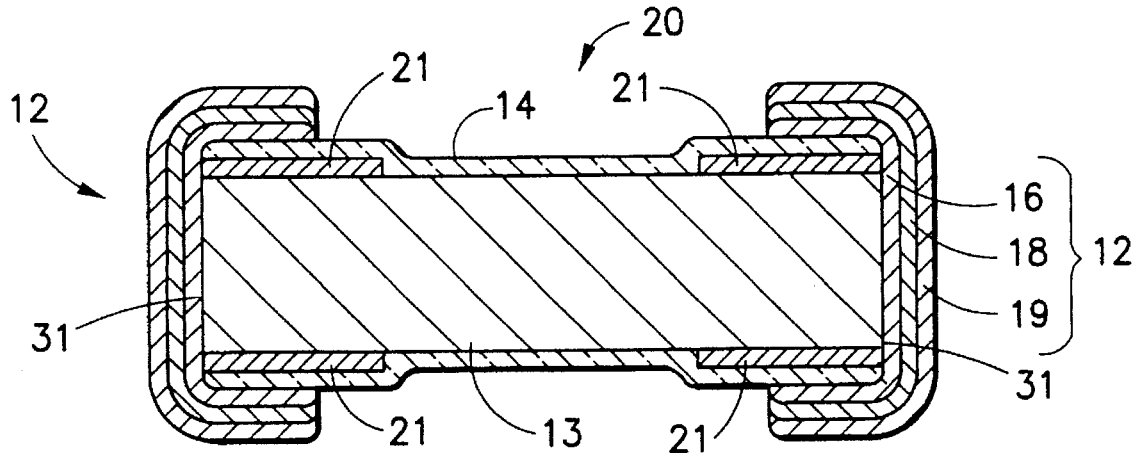
FIG. 4 is a longitudinal cross-sectional view of a thermistor having an internal resistance regulating electrode according to a second embodiment of the present invention.

Referring now to FIG. 4, in a second embodiment of the invention, a thermistor 20 includes an internal resistance regulating electrode 21. Specifically, four internal resistance regulating electrodes 21, two on each end, are placed on the surface of thermistor element 13. Internal resistance regulating electrodes 21 remain outside end surfaces 31 of thermistor element 13. Internal resistance regulating electrodes 21 are electrically connected to respective terminal electrodes 12. Insulating glass layer 14 covers thermistor element 13 as before, including the surface of internal resistance regulating electrode 21. As before, part or all of insulating glass layer 14 is made of crystallized glass.

Referring to FIG. 6(*a*) a ceramic sintered sheet 11 is prepared according to the method described previously. A conductive paste, which forms a precursor for internal resistance regulating electrodes 21, containing precious metal powder and inorganic binder, is printed in bands, directly above one another, at intervals, on both sides of ceramic sintered sheet 11. The resulting intermediate product is dried and baked at sintering temperature to form ceramic sintered sheet 11, with internal resistance regulating electrodes 21 positioned as shown.

Referring now also to FIG. 6(*b*), a precursor to insulating glass layer 14 is printed on the both sides of ceramic sintered sheet 11, and covering internal resistance regulating electrodes 21. Ceramic sintered sheet 11 is then baked, forming insulating glass layer 14.

Referring now to FIG. 6(*c*), strips 35 are formed by cutting ceramic sintered sheet 11 in the direction indicated by arrows perpendicular to internal resistance regulating electrode 21.

Referring now to FIG. 6(*d*), a glass paste, as described before, is printed and baked on the exposed cut surfaces of thermistor element 13 to form insulating glass layers 14' on both edges of strips 35. Strips 35 baked and cut into chip 15 by finely cutting strips 35 in a direction parallel to internal resistance regulating electrode 21 and along the center line (indicated by arrows) of internal resistance regulating electrode 21.

A conductive paste (not shown) is applied to both cut ends of chip 15. Chip 15 is then baked, forming baked-on electrode layer 16.

Referring to FIG. 4, a Ni plating layer 18 is applied to baked-on electrode layer 16. A Sn/Pb plating layer 19 is plated onto Ni plating layer 18 to complete terminal electrodes 12.

The composition and function of internal resistance regulating electrode 21 is well known in the art, and will not be further described. In addition, the inventive content of the present disclosure is contained elsewhere than in internal resistance regulating electrode 21.

Figure 5:
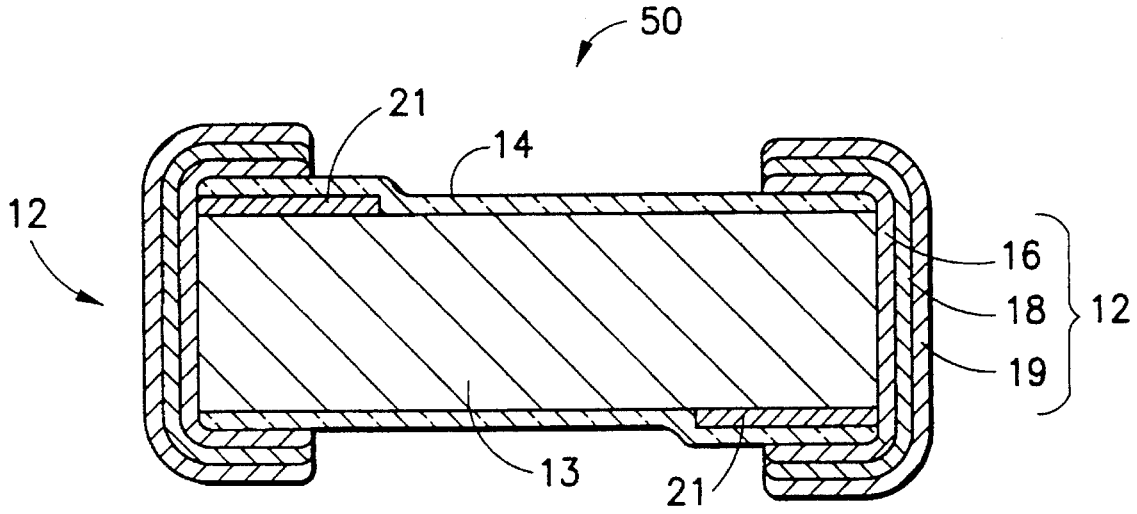
FIG. 5 is a longitudinal cross-sectional view of a third embodiment of the present invention.
Figure 6A:
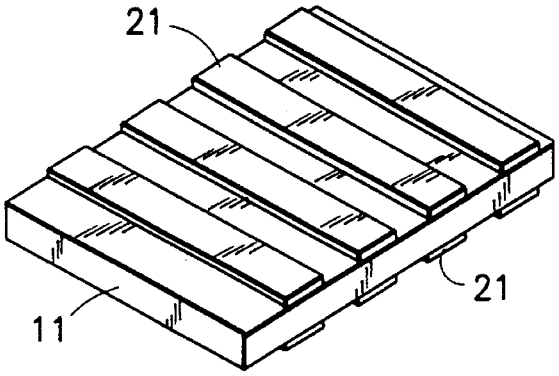
FIG. 6(*a*)–6(*f*) illustrates the steps for manufacturing the embodiment of FIG. 4.
Figure 6D:
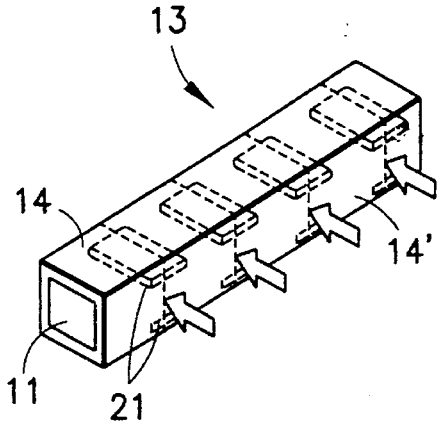
Figure 6B:
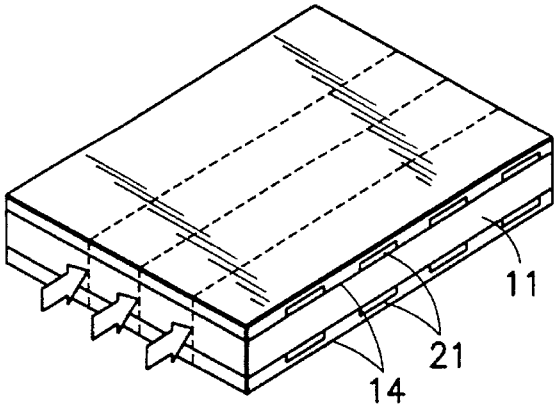
Figure 6E:
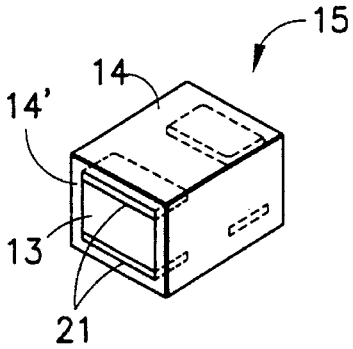
Figure 6C:
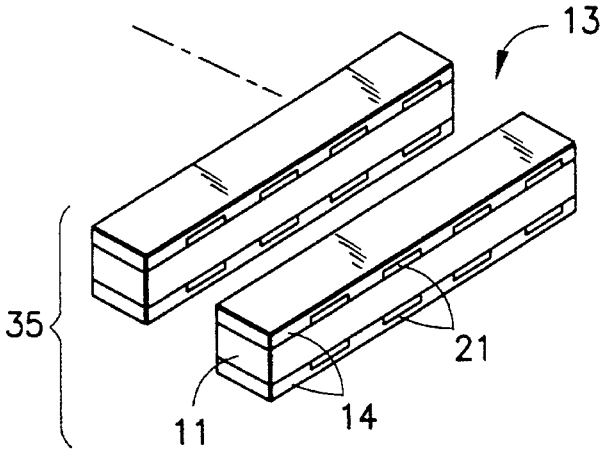
Figure 6F:
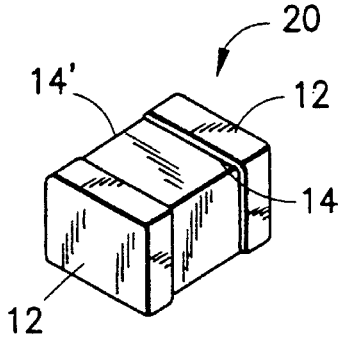

Referring now to FIG. 5, a third embodiment of the present invention is shown. A thermistor 50 has two internal resistance regulating electrodes 21, rather than the four internal resistance regulating electrodes 21 of the embodiment of FIGS. 4 and 6(*a*)–6(*f*). Bands of conductive paste are printed on both sides of thermistor element 13, in a manner analogous to the technique shown in FIGS. 6(*a*)–6(*f*). However, the bands are offset by one column, resulting in each thermistor 50 having only one internal resistance regulating electrode 21.

Figure 7:
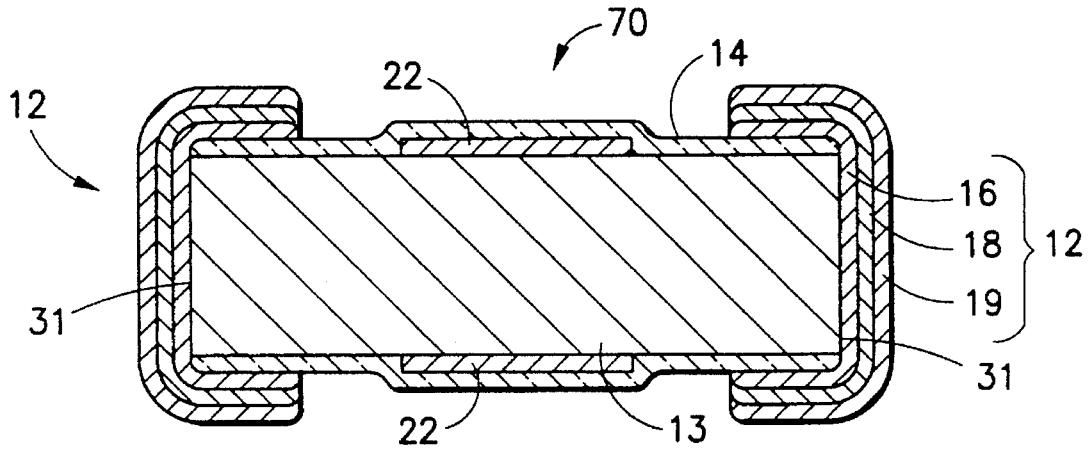
FIG. 7 is a longitudinal cross-sectional view of a fourth embodiment of the present invention.

Referring to FIG. 7, a fourth embodiment of the present invention is shown. A thermistor 70 includes an internal resistance regulating electrode 22, centered on both sides between the ends of thermistor element 13. Internal resistance regulating electrode 22 does not touch or cover end surfaces 31. Unlike the second and third embodiments, internal resistance regulating electrode 22 does not electrically contact terminal electrodes 12. As described above, insulating glass layer 14, made of at least partially crystallized glass, covers the entire surface of thermistor element 13 including internal resistance regulating electrode 22. However, as stated earlier, insulating glass layer 14 does not cover end surfaces 31.

Thermistor 70 is manufactured as detailed in FIGS. 6(*a*) through 6(*f*), except that, in FIG. 6(*d*), strip 35 is cut in a direction parallel to internal resistance electrode 21 and halfway between two adjacent internal resistance regulating electrodes 21 to form chip 15.

Figure 8:
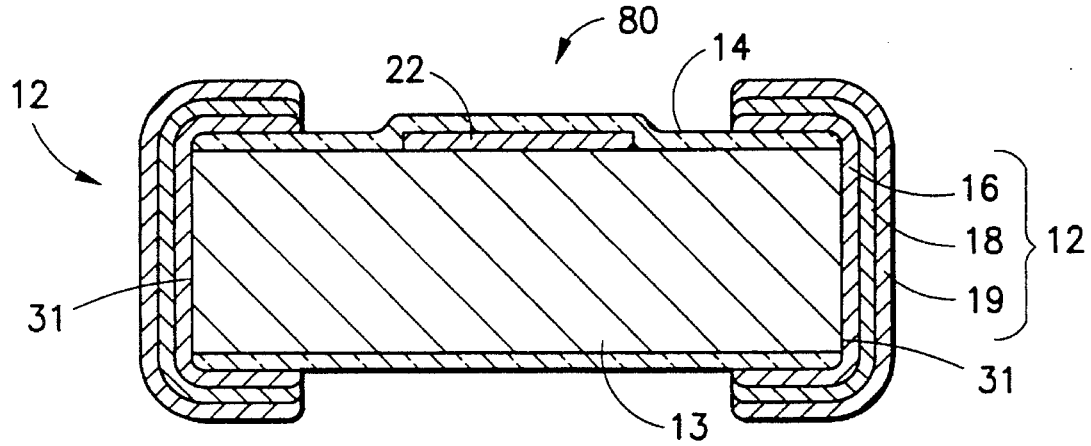
FIG. 8 is a longitudinal cross-sectional view of a fifth embodiment of the present invention.

Referring to FIG. 8, a fifth embodiment of the present invention is shown. A thermistor 80 has one internal resistance regulating electrode 22 disposed on the surface of thermistor element 13. The manufacturing of thermistor 80 is similar to that described in the third and fourth embodiments. Similar to the third embodiment, the bands of conductive paste 36 are arranged in an offset relationship. In addition, strip 35 is cut in a manner similar to the fourth embodiment. This results in each thermistor 80 having one internal resistance regulating electrode 22.

Figure 9:
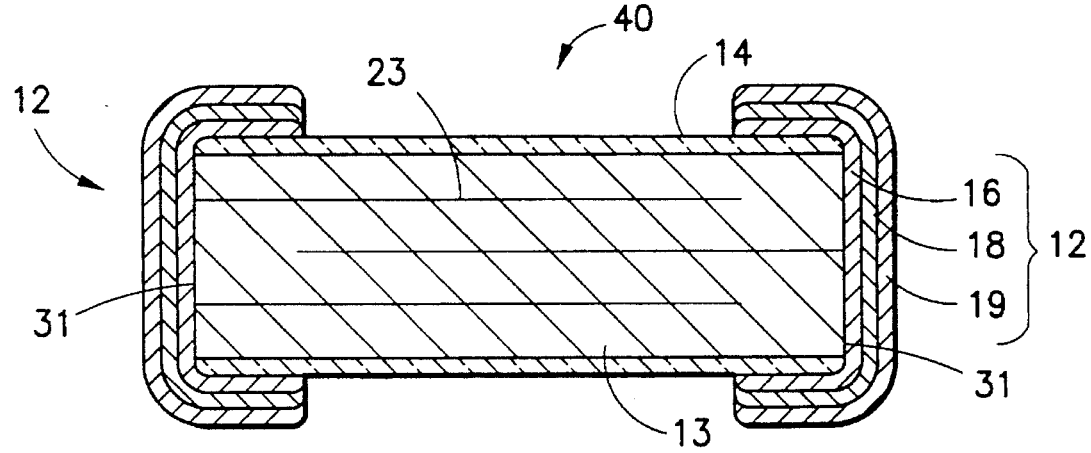
FIG. 9 is a longitudinal cross-sectional view of a sixth embodiment of the present invention.
Figure 10:
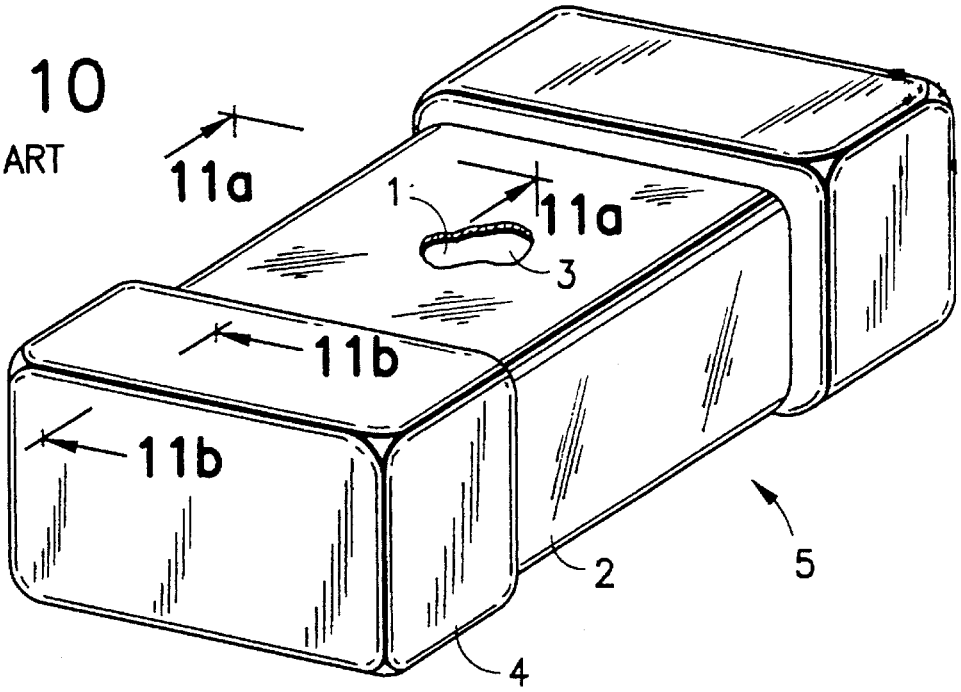
FIG. 10 PRIOR ART
FIG. 10 is a perspective view of a prior art thermistor.
Figure 11A:
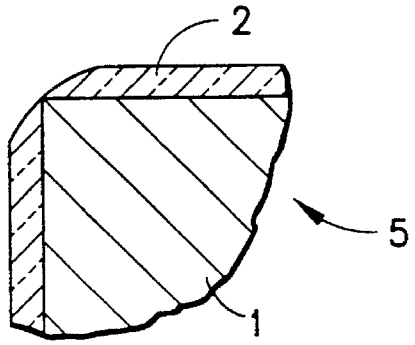
FIG. 11(a) PRIOR ART
FIG. 11(*a*) is an enlarged cross-sectional view taken along line B—B.
Figure 11B:
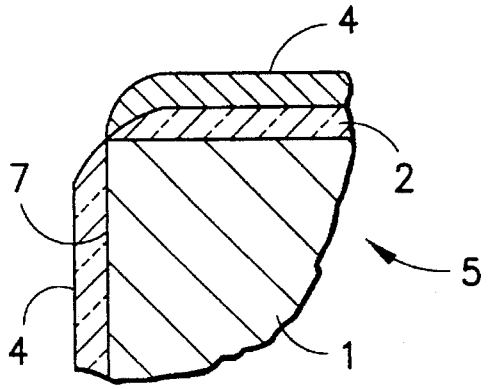
FIG. 11(b) PRIOR ART

Referring to FIG. 9, a sixth embodiment of the present invention is shown. A thermistor 40 includes at least one resistance regulating electrode 23 internal to thermistor element 13. Resistance regulating electrode 23 is in electrical contact with one of terminal electrodes 12. As before, insulating glass layer 14, which is at least partially crystallized glass, covers thermistor element 13 except for end surfaces 31. In a preferred embodiment, a plurality of resistance regulating electrodes 23 (three are shown) are disposed within thermistor element 13. In the embodiment shown, the three resistance regulating electrodes 23 are interleaved, with the first and third (counting from the top in the figure) being connected to the left-hand terminal electrode 12, and the second (center) being connected to the right-hand terminal electrode 12.

A seventh embodiment of the invention includes a thermistor similar to thermistor 40 of FIG. 9, except that its internal resistance regulating electrode 23 is out of electrical contact with terminal electrodes 12.

Thermistor 40 begins as an extremely thin ceramic sheet (not shown). Conductive paste is printed on the top surfaces of a plurality of ceramic sheets and dried, forming first resistance regulating electrodes 23. Then, the plurality of ceramic sheets are stacked. The stack is then baked to form a sintered sheet containing resistance regulating electrodes 23 buried therein. The remaining steps are those described by FIGS. 6(*b*)–6(*f*).

By setting the coefficient of thermal expansion of the crystallized glass lower than the coefficient of thermal expansion of the thermistor element by an appropriate margin, a greater compression stress is applied to the insulating glass layer of the thermistor. When a bending force is applied, this thermistor does not crack as easily from the tensile stress on the outside curve of the bend as compared to a thermistor having no insulating glass layer or a thermistor having art insulating glass layer made of uncrystallized glass.

As stated above, by forming an insulating glass layer with crystallized glass, the insulating glass layer does not soften and change shape during formation of the baked-on electrode, nor does the insulating glass layer stick to baking tools, nor does the baked-on electrode layer melt into the insulating glass layer, resulting in a smooth insulating glass layer. Furthermore, the insulating glass layer and the baked-on electrode layer maintain their shapes better, resulting in a more aesthetically pleasing thermistor.

After formation of the baked-on electrode layer, the insulating glass layer prevents the erosion of the thermistor by plating fluids, leaving the resistance unchanged and allowing production of highly reliable thermistors.

By selecting the coefficient of thermal expansion appropriately, the anti-breaking strength of the thermistor is improved over the anti-breaking strength of a thermistor with an insulating glass layer formed from uncrystallized glass.

EXAMPLES

Example 1

A chip-type thermistor according to the first embodiment of the invention was manufactured as follows.

A ceramic sheet was formed from commercially available manganese oxide, cobalt oxide and copper oxide. They were mixed such that their metal elements were in a weight ratio of 40:5:5:5. The mixture was mixed for 16 hours in a ball mill to achieve uniformity, then dehydrated and dried. The mixture was then calcined for two hours at 900 ÛC. The calcined product was again crushed by a ball mill and dried. A combination of binding materials including 6 weight percent of polyvinyl butyryl, 30 weight percent of ethanol and 30 weight percent butanol were added to the powder and mixed to form a slurry.

The slurry was formed into a film by a doctor blade and dried to form a green sheet 0.80 mm thick. A 70 mm×70 mm sheet was punched from this sheet. The sheet was then baked for 4 hours at 1200 ÛC, producing a sintered sheet having a vertical length of 50 mm, a horizontal length of 50 mm and a thickness of 0.65 mm.

A glass paste was prepared, by mixing together raw glass powder having as the main components: $SiO_2$, ZnO and BaO. The glass transition point of the raw glass powder was approximately 650 ÛC and the crystallization temperature was approximately 750 ÛC. The glass components were mixed together uniformly with a binder to form the glass paste. This glass paste was then printed on both sides of the sintered sheet and dried.

After the glass paste has dried, the sintered sheet was heated from room temperature to 850 ÛC at a rate of approximately 30 ÛC/minute. This temperature was maintained for approximately 10 minutes and then the sintered sheet was cooled to room temperature at the same rate. The glass paste thus was converted to an insulating glass layer having a thickness of approximately 20 microns.

The sintered sheet was then cut into 1.20 mm wide strips using a 0.10 mm thick diamond blade. The glass paste was then applied to the now exposed cut surfaces to form an insulating glass layer, as described above. As a result, four sides of the strip are covered with an insulating glass layer.

The strip was then finely cut in a direction perpendicular to the previous cut to forming 1.90 mm long chips. An Ag paste was applied to the remaining exposed surfaces and the immediately surrounding insulating glass layer. The chip was then heated from room temperature to 850 ÛC at a rate of 30 ÛC/minute. This temperature was maintained for 10 minutes, and then cooled to room temperature at the same rate. This forms the baked-on electrode layer. This baking turns the four surfaces of the insulating glass layer into crystallized glass with a crystallization rate of approximately 60 percent. The resulting chip was approximately 2.0 mm long, approximately 1.25 mm wide, and approximately 0.75 mm thick.

Finally, the baked-on electrode layer was electroplated with a 2–3 micron thick layer of Ni plating and a 4–5 micron thick layer of Sn plating. A two-layer plating layer structure was thus formed on the surface of the baked-on electrode layer. As a result, the chip-type thermistor had a pair of terminal electrodes on the ends thereof composed of a baked-on electrode layer and two plating layers.

The coefficient of thermal expansion of the sintered sheet was measured to be $130\times10^{-7}$/ÛC and the coefficient of thermal expansion of the crystallized glass, resulting from the baking of the glass paste under the same conditions as noted above, was measured to be $100\times10^{-7}$/ÛC. This means that the latter coefficient was 77 percent of the former coefficient, falling within the previously stated preferred range.

Comparison Product 1

A glass paste was prepared from a) 80 weight percent of raw glass powder having main components: $SiO_2$, PbO and $K_2O$, having a softening point of the raw glass was approximately 500 ÛC and b) 20 weight percent of $Zr_2O$ powder as inorganic crystals. A chip-type thermistor identical to that of example 1 was formed using the above glass paste. The glass component and the inorganic crystals did not mix uniformly in the paste. Also, under the same baking conditions as in example 1, the glass layer for this thermistor did not crystallize. The coefficient of thermal expansion of this uncrystallized glass was approximately $50\times10^{-7}$/°C. and was thus approximately 38 percent of the coefficient of thermal expansion of the sintered sheet.

Comparing the chip-type thermistors of example 1 and comparative product 1, the following characteristics were examined: the printing quality of the glass paste; the degree to which the shape of the insulating glass layer and the electrode layer was maintained after formation of the baked-on electrode layer; melt adhesion traces on the insulating glass layer; the presence of bubbles in the insulating glass layer; the surface condition of the insulating glass layer; and the anti-breaking strength. The results were tabulated and are presented in Table 1. Excluding the anti-breaking strength, the figures in Table 1 indicate the number of faulty thermistors out of the sample number (20 pieces).

TABLE 1

| Characteristic | sample count = 20 Embodiment 1 | Comparison 1 |
|---|---|---|
| Printability | 0 Good | 20 Bad |
| Presence of edge leaks on glass layer | 0 Good | 10 Bad |
| Melting of electrode layer into glass | 0 Good | 7 Bad |
| Presence of contact marks on glass layer | 0 Good | 12 Bad |
| Bubbles in glass layer | 0 Good | 12 Bad |
| Irregularity of glass layer surface | 0 Good | 15 Bad |
| Anti-breaking strength | Avg. = 3.33 kgf | Avg. = 2.67 kgf |

As Table 1 makes clear, the thermistor of embodiment 1, having an insulating glass layer made of crystallized glass, was superior to comparison product 1 having an insulating glass layer made of uncrystallized glass.

Example 2

A chip-type thermistor according to the second embodiment of the invention was manufactured as follows. A sintered sheet, identical to the one in example 1, was produced measuring 50 mm long by 50 mm wide by 0.65 mm thick. Bands of 0.6 mm Ag paste was printed on both sides of ceramic sintered sheet 11 at intervals of 1.4 mm. The bands of Ag paste were dried. The bands were laid out so that they sandwiched the sintered sheet. The sintered sheet was baked at 820 ÛC, forming a plurality of 10 micron thick electrodes.

A glass paste, identical to the one used in example 1, was printed on both sides of the sintered sheet, and dried. The sintered sheet was baked under the same conditions as example 1, forming a 30 micron thick insulating glass layer on the sheet surface.

The sintered sheet was then cut into 1.20 mm wide strips with a 0.10 mm diamond blade in a direction perpendicular to the bands laid out previously. The glass paste, as in example 1, was applied to the now exposed surfaces to form a insulated glass layer.

The strips were then finely cut to form 1.90 mm long chips. The cuts were made along the center line of the electrode in a direction perpendicular to the previous cuts.

Ag paste was applied to the now exposed surfaces and on the immediately surrounding insulating glass layer. The chip was baked as in example 1, to form a baked-on electrode layer. This baking turns the 4 -sided insulated glass layer into crystallized glass, at a crystallization rate of 60 percent. The resulting chip was approximately 2.0 mm long, approximately 1.3 mm wide, and approximately 0.75 mm thick.

The chip was then electroplated with a 2–3 micron thick Ni plating layer and a 4–5 micron thick Sn plating layer. This formed a two layer plating layer on the surface of the baked-on electrode layer. As a result, the chip-type thermistor had a pair of terminal electrodes having a baked-on electrode layer and two plating layers.

The coefficient of thermal expansion of the sintered sheet before the electrode was formed was measured to be $130\times10^{-7}$/ÛC and the coefficient of thermal expansion of the crystallized glass resulting from baking the above glass paste was $100\times10^{-7}$/ÛC, 77 percent of the former.

Comparison Product 2

A chip-type thermistor was made as described in example 2 using the glass paste described in comparison product 1. As before, the glass components and the inorganic crystals did not mix uniformly in the paste. Also, the raw glass did not crystallize under the baking conditions described for example 2, resulting in an uncrystallized insulating glass layer. The coefficient of thermal expansion for this uncrystallized glass was approximately $50\times10^{-7}$/ÛC, which was approximately 38 percent of the sintered sheet.

Examining the chip-type thermistors of example 2 and of comparative product 2, the following characteristics were studied: the printing quality of the glass paste; the degree to which the shape of the insulating glass layer and the baked-on electrode layer was maintained after formation of the baked-on electrode layer; the melt adhesion traces on the insulating glass layer; the presence of bubbles in the insulating glass layer; the surface condition of the insulating glass layer; and the anti-breaking strength. The results are shown in Table 2. The figures in Table 2 have the same significance as those in Table 1.

TABLE 2

| Characteristic | sample count = 20 Embodiment 2 | Comparison 2 |
|---|---|---|
| Printability | 0 Good | 20 Bad |
| Presence of edge leaks on glass layer | 0 Good | 9 Bad |
| Melting of electrode layer into glass | 0 Good | 5 Bad |
| Presence of contact marks on glass layer | 0 Good | 12 Bad |
| Bubbles in glass layer | 0 Good | 10 Bad |
| Irregularity of glass layer surface | 0 Good | 9 Bad |
| Anti-breaking strength | Avg. = 3.01 kgf | Avg. = 2.43 kgf |

As Table 2 makes clear, the thermistor of example 2, having an insulating glass layer of crystallized glass, was superior in all categories to the thermistor of comparative product 2, having an insulating glass layer of uncrystallized glass.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A thermistor, comprising:

a thermistor element having first and second opposed end surfaces, and first, second third and fourth peripheral sides;

an insulating glass layer on said first, second third and fourth peripheral sides;

said first and second opposed end surfaces being substantially free of said insulating glass layer;

said insulating glass layer being at least partially crystallized glass;

a terminal electrode on each of said first and second opposed end surfaces; and said terminal electrode having a baked-on electrode layer in contact with its respective end surface, and at least one plated layer on said baked-on electrode layer.

2. A thermistor as recited in claim 1, wherein said insulating glass layer includes a substantial proportion of said crystallized glass.

3. A thermistor as recited in claim 1, wherein:

a transition temperature for said insulating glass layer before crystallization is in a range from about 400° C. to about 1000° C.; and a crystallization temperature of said insulating glass layer is higher than said transition temperature.

4. A thermistor as recited in claim 1, wherein said insulating glass layer includes a mixture of $SiO_2$, ZnO and BaO.

5. A thermistor as recited in claim 1, wherein:

said at least one plated layer includes a first plated layer on said baked-on electrode layer, and second plated layer on said first plated layer;

said first plated layer is nickel; and said second plated layer is selected from the group consisting of Sn and a mixture of Sn/Pb.

6. A thermistor, comprising:

a thermistor element having first and second opposed end surfaces, and first, second third and fourth peripheral sides;

an insulating glass layer on said first, second third and fourth peripheral sides;

said first and second opposed end surfaces being substantially free of said insulating glass layer;

said insulating glass layer being at least partially crystallized glass;

a terminal electrode on each of said first and second opposed end surfaces; and said crystallized glass has a thermal expansion coefficient of from about 40 to about 100% of a thermal expansion coefficient of said thermistor element.

7. A thermistor as recited in claim 6, wherein:

said crystallized glass has a thermal expansion coefficient of from about 50 to about 90% of a thermal expansion coefficient of said thermistor element.

8. A thermistor as recited in claim 1, further comprising:

at least one internal resistance regulating: electrode on at least one of said first, second, third and fourth peripheral sides element; and said insulating glass layer covering said at least one internal resistance regulating electrode.

9. A thermistor as recited in claim 1, further comprising:

at least two internal resistance regulating electrodes on at least one of said first and third peripheral sides.

10. A thermistor as recited in claim 9, wherein said at least two internal resistance regulating electrodes are electrically connected to respective terminal electrodes.

11. A thermistor as recited in claim 8, wherein said at least one internal resistance regulating electrode is within said thermistor element.

12. A thermistor as recited in claim 11, wherein said at least one internal resistance regulating electrode is electrically connected to said terminal electrode.

13. A thermistor as recited in claim 6, wherein said insulating glass layer includes a substantial proportion of said crystallized glass.

14. A thermistor as recited in claim 6, wherein:

a transition temperature for said insulating glass layer before crystallization is in a range from about 400° C. to about 1000° C.; and a crystallization temperature of said insulating glass layer is higher than said transition temperature.

15. A thermistor as recited in claim 6, further comprising:

at least one internal resistance regulating electrode on at least one of said first, second, third and fourth peripheral sides element; and said insulating glass layer covering said at least one internal resistance regulating electrode.

16. A thermistor as recited in claim 6, further comprising:

at least two internal resistance regulating electrodes on at least one of said first and third peripheral sides.

17. A thermistor as recited in claim 16, wherein said at least two internal resistance regulating electrodes are electrically connected to respective terminal electrodes.

18. A thermistor as recited in claim 15, wherein said at least one internal resistance regulating electrode is within said thermistor element.

19. A thermistor as recited in claim 18, wherein said at least one internal resistance regulating electrode is electrically connected to said terminal electrode.

20. A thermistor as recited in claim 6, wherein said insulating glass layer includes a mixture of $SiO_2$, ZnO and BaO.

* * * * *